US010184423B2

(12) United States Patent
Richter et al.

(10) Patent No.: US 10,184,423 B2
(45) Date of Patent: Jan. 22, 2019

(54) TWO-STROKE ENGINE

(71) Applicant: Andreas Stihl AG & Co. KG, Waiblingen (DE)

(72) Inventors: Stefan Richter, Remseck (DE); Gordon Groskopf, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 150 days.

(21) Appl. No.: 15/289,649

(22) Filed: Oct. 10, 2016

(65) Prior Publication Data

US 2017/0107937 A1 Apr. 20, 2017

(30) Foreign Application Priority Data

Oct. 20, 2015 (DE) ..... 10 2015 013 786

(51) Int. Cl.
*F02F 3/24* (2006.01)
*F02B 25/14* (2006.01)
*F02B 75/02* (2006.01)

(52) U.S. Cl.
CPC ..... *F02F 3/24* (2013.01); *F02B 25/14* (2013.01); *F02B 75/02* (2013.01); *F02B 2075/025* (2013.01)

(58) Field of Classification Search
CPC ..... F02F 3/24; F02B 75/02; F02B 2075/025; F02B 25/14; F02B 25/00; F02B 25/04; F02B 25/06; F02B 25/145; F02B 25/20
See application file for complete search history.

(56) References Cited

U.S. PATENT DOCUMENTS

| | | | | |
|---|---|---|---|---|
| 8,261,701 | B2 * | 9/2012 | Amann | F01B 1/04 123/41.58 |
| 8,671,897 | B2 | 3/2014 | Geyer et al. | |
| 9,938,889 | B2 * | 4/2018 | Kurata | F02B 25/02 |
| 2001/0018900 | A1 * | 9/2001 | Matsuda | F02B 33/04 123/73 A |
| 2015/0184579 | A1 * | 7/2015 | Yamada | F02B 25/04 123/65 P |

* cited by examiner

*Primary Examiner* — Jacob Amick
(74) *Attorney, Agent, or Firm* — Walter Ottesen, P.A.

(57) ABSTRACT

A two-stroke engine is provided that has a cylinder, in which a combustion chamber is formed, and a piston, which delimits the combustion chamber and which drives a crankshaft rotatably mounted in a crankcase. The piston controls an inlet window for fuel/air mixture into the crankcase interior. A flow guide element is arranged in the crankcase interior which extends adjacent to the inlet window. The flow guide element has at least one first inflow surface by which at least a first partial quantity of the fuel/air mixture flowing in through the inlet window is diverted in the direction of the crankshaft.

15 Claims, 5 Drawing Sheets

TWO-STROKE ENGINE

CROSS REFERENCE TO RELATED APPLICATION

This application claims priority of German patent application no. 10 2015 013 786.7, filed Oct. 20, 2015, the entire content of which is incorporated herein by reference.

BACKGROUND OF THE INVENTION

U.S. Pat. No. 8,671,897 describes a two-stroke engine of the generic type. In the crankcase interior there is arranged a flow guide element which diverts the fuel/air mixture flowing into the crankcase interior through the inlet window toward the piston base.

SUMMARY OF THE INVENTION

It is an object of the invention to provide a two-stroke engine of the generic type in which the lubricating action during operation is improved.

The two-stroke engine of the invention includes: a cylinder defining a longitudinal cylinder axis and having a combustion chamber formed therein; a piston arranged in the cylinder so as to carry out a reciprocating back and forth movement therein; the piston delimiting the combustion chamber; a crankcase defining an interior; an inlet window controlled by the piston for supplying a fuel/air mixture to the crankcase; an outlet window leading out of the combustion chamber; at least one transfer channel via which combustion air flows from the interior of the crankcase into the combustion chamber; a crankshaft rotatably journaled in the crankcase for rotating about a rotational axis; a connecting rod connected to the piston via a piston pin; the piston driving the crankshaft via the connecting rod; the connecting rod being journaled on a crankpin of the crankshaft; the piston having a piston base defining a lower end facing toward the crankcase; a flow guide element arranged in the interior of the crankcase so as to extend adjacent to the inlet window; and, the flow guide element having at least a first inflow surface configured to divert at least a first partial quantity of the fuel/air mixture flowing in through the inlet window in a direction toward the crankshaft.

It has been found that inadequate lubrication of the crankpin bearing at which the connecting rod is mounted on the crankshaft may arise if, in the crankcase interior, there is arranged a flow guide element which diverts the inflowing mixture toward the piston base. To achieve adequate lubrication of the crankpin bearing during operation, provision is now made for at least one first inflow surface to be provided which diverts at least a first partial quantity of the fuel/air mixture flowing in through the inlet window in the direction of the crankshaft. In this way, adequate lubrication of the crankshaft, in particular of the crankpin bearing, can be ensured. Here, the first inflow surface is oriented such that, during a piston stroke, the inflowing fuel/air mixture strikes at least one region of the crankshaft, that is, normally the crankpin and/or at least one of the crank webs arranged at both sides on the crankpin and/or at least one bearing section, which is mounted in the crankshaft bearing, of the crankshaft. The two-stroke engine is a mixture-lubricating engine. The fuel accordingly contains oil for the lubrication of the moving parts in the crankcase. The oil is supplied into the crankcase interior together with the fuel and the combustion air in the form of a fuel/air mixture.

According to an aspect of the invention, at least one first inflow surface diverts a first partial quantity of the fuel/air mixture flowing in through the inlet window in the direction of the crankshaft, and at least one second inflow surface diverts a second partial quantity of the fuel/air mixture flowing in through the inlet window in the direction of a bottom side of the piston base. The first and the second inflow surface cause the inflowing fuel/air mixture to be split up in the direction of the crankcase and in the direction of the bottom side of the piston base. In this way, it is possible to ensure good lubrication and cooling of the piston pin bearing and of the crankpin bearing. Through suitable configuration of the inflow surfaces, it is possible to set the magnitude of the fraction of the fuel/air mixture flowing to the crankshaft in relation to the total quantity of the fuel/air mixture flowing into the crankcase interior. In this way, very good lubrication of the two-stroke engine is ensured in a simple manner. It may however also be advantageous for the two-stroke engine to have only a first inflow surface, and for adequate lubrication of the piston pin bearing to be ensured in some other way. The first inflow surface directs the inflowing fuel/air mixture downward in the direction of the crankshaft bearing. The two inflow surfaces may advantageously be provided on a common flow guide element. According to another aspect of the invention, separate flow guide elements may be provided for the two inflow surfaces.

The crankcase advantageously has an inlet end and an outlet end, which are separated by a transverse plane. The transverse plane of the two-stroke engine is in this case the plane that encompasses the longitudinal cylinder axis and the axis of rotation of the crankshaft. The inlet end is that side of the crankcase at which the inlet window opens out when the piston is at top dead center. The outlet end is that side of the transverse plane which is averted from the inlet end. To realize good lubrication of the crankshaft, in particular of the crankpin bearing, it is advantageously provided that the first inflow surface diverts the first partial quantity of the inflowing combustion air to the inlet end of the crankcase. In this way, good lubrication of the crankshaft bearings is also realized. The crankshaft bearings are the bearings by which the crankshaft is rotatably mounted in the crankcase. The rotational direction of the crankshaft is advantageously selected such that the crankpin bearing, at the inlet end, moves in the direction of the combustion chamber and, at the outlet end, moves away from the combustion chamber. By virtue of the fact that the first partial quantity of the inflowing fuel/air mixture is diverted to the inlet end, the fuel/air mixture flows toward the piston pin bearing. The first partial quantity of the inflowing fuel/air mixture forms, at the inlet end in the crankcase interior, a cloud through which the crank pin bearing moves during the upward stroke of the piston. Adequate lubrication of the crankpin bearing can be ensured in this way. Here, the first inflow surface is advantageously arranged on the inlet side of the crankcase. According to another aspect of the invention, the entire flow guide element is arranged on the inlet side. The cloud has a high concentration of oil and fuel, because the mixture formation takes place at least partially in the crankcase. This is the case in particular if fuel and oil are supplied via a carburetor. In the case of fuel being supplied via a carburetor, only a partial mixture formation takes place in the intake channel.

In a section plane which encompasses the longitudinal cylinder axis and which is perpendicular to the axis of rotation of the crankshaft, the first inflow surface is advantageously arranged so as to lie at least partially between an extension of a top side and an extension of a bottom side of an inlet channel which opens out at the inlet window. A part of the inflowing fuel/air mixture thus flows directly onto the first inflow surface and is conducted directly into the crankcase interior. The first inflow surface has an inflow edge situated so as to face toward the inlet window. The inflow edge is that region of the first inflow surface which is impinged on first by the inflowing fuel/air mixture. The expression "inflow edge" is in this case to be interpreted broadly. In this context, an inflow edge may also be a rounded region, which is impinged on first by the inflowing fuel/air mixture, of the inflow surface.

The crankcase has a crankshaft plane which encompasses the axis of rotation of the crankshaft and which is perpendicular to the longitudinal cylinder axis. The bottom edge of the inlet window denotes that region of the inlet window which has the smallest spacing, measured parallel to the longitudinal cylinder axis, to the crankshaft plane. Provision is advantageously made for the bottom edge of the inlet window to be situated closer than the inflow edge of the first inflow surface to the crankshaft plane. The spacing, measured parallel to the longitudinal cylinder axis, of the inflow edge to the crankshaft plane is accordingly advantageously greater than the spacing of the bottom edge of the inlet window to the crankshaft plane. The inflow edge is accordingly arranged closer than the lower edge of the inlet window to the combustion chamber. In this way, the inflow edge is impinged on directly by the combustion air flowing in through the inlet window. The inflow edge and the bottom edge of the inlet window advantageously have a spacing, measured parallel to the longitudinal cylinder axis, which amounts to no more than 50% of a height, measured parallel to the longitudinal cylinder axis, of the inlet window. The spacing between the inflow edge and the bottom edge of the inlet window is in this case measured in a section plane lying perpendicular to the axis of rotation of the crankshaft. The spacing between the inflow edge and the bottom edge of the inlet window preferably amounts to 25% to 50% of the height of the inlet window. The inlet window may for example be of circular, elliptical or flattened form, or may have an irregular shape. Here, the inflow edge is advantageously further remote than the lower edge from the crankshaft plane, such that the inflow edge is situated opposite a middle to lower region of the inlet window.

The first inflow surface advantageously has a separation edge at its side averted from the inlet channel. Here, the separation edge need not be a sharp edge, but rather denotes the region at which the fuel/air mixture flowing in through the inlet window separates from the first inflow surface. The two-stroke engine advantageously has an imaginary central plane which encompasses the longitudinal cylinder axis and which is perpendicular to the axis of rotation of the crankshaft. The imaginary central plane, the transverse plane and the crankshaft plane are thus oriented perpendicular to one another. The separation edge is advantageously arranged such that, in a viewing direction perpendicular to the imaginary central plane, in particular in a sectional illustration through the imaginary central plane, a tangent to the first inflow surface, the tangent running through the separation edge, intersects the longitudinal cylinder axis at an intersection point which has a spacing of less than 2 cm from the axis of rotation of the crankshaft. The tangent preferably intersects the longitudinal cylinder axis on that side of the crankshaft plane which faces toward the combustion chamber. It is achieved in this way that the fuel/air mixture that is diverted by the first inflow surface is conducted into a region through which the crankpin bearing passes during the upward stroke of the piston. The tangent through the separation edge encloses an angle with the longitudinal cylinder axis which advantageously amounts to 5° to 40°. The angle particularly advantageously amounts to 10° to 25°.

The width, measured parallel to the axis of rotation of the crankshaft, of the first inflow surface is advantageously smaller than the width, measured parallel to the axis of rotation of the crankshaft, of the inlet window. In this way, only a part of the inflowing fuel/air mixture is guided into the crankcase interior by the first inflow surface. The width of the first inflow surface is in this case advantageously measured in a section plane perpendicular to the longitudinal cylinder axis. The width of the first inflow surface advantageously amounts to 10% to 50% of the width of the inlet window. The width of the first inflow surface particularly advantageously amounts to 20% to 40% of the width of the inlet window. The width of the inlet window and the width of the first inflow surface is in this case in each case the greatest width of inflow surface and inlet window.

To realize good cooling of the piston and good lubrication of the piston pin bearing, it is advantageously provided that the flow guide element has at least one second inflow surface which diverts a second partial quantity of the fuel/air mixture flowing in through the inlet window in the direction of the bottom side of the piston base. To realize expedient flow guidance and a low flow resistance, it is advantageously provided that the first inflow surface and the second inflow surface are concavely curved. The first and/or the second inflow surface may however also be formed as planar surfaces. By way of the two inflow surfaces, it is possible to realize a good distribution of the inflowing fuel/air mixture, such that a first partial quantity is diverted in the direction of the crankcase interior and a second partial quantity is diverted in the direction of the bottom side of the piston base. The concave curvature results in a low flow resistance and a streamlined diversion. The first inflow surface and the second inflow surface advantageously abut against one another at a flow divider. The flow divider is preferably formed as a straight edge running parallel to the axis of rotation of the crankshaft. A rounded or curved form or a suitable arrangement of the flow divider may however also be advantageous. The first partial quantity of the inflowing fuel/air mixture, which is diverted in the direction of the crankcase interior, is preferably smaller than the second partial quantity, which is diverted in the direction of the bottom side of the piston base. This can be easily realized by virtue of the width, measured parallel to the axis of rotation of the crankshaft, of the second inflow surface amounting to at least 1.5 times, in particular at least 2 times, the width of the first inflow surface. The second inflow surface advantageously has a cutout which is adjoined by the first inflow surface. An expedient arrangement of the first inflow surface is realized in this way.

The flow divider is advantageously arranged so as to stand in the fuel/air mixture flowing in through the inlet window. In the case of a central arrangement of the inlet window, it is advantageously provided that the flow divider is partitioned by an imaginary central plane. The second inflow surface is advantageously larger than the first inflow surface. In this way, it is possible for adequate cooling of the piston base and lubrication of the piston pin bearing to be realized.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
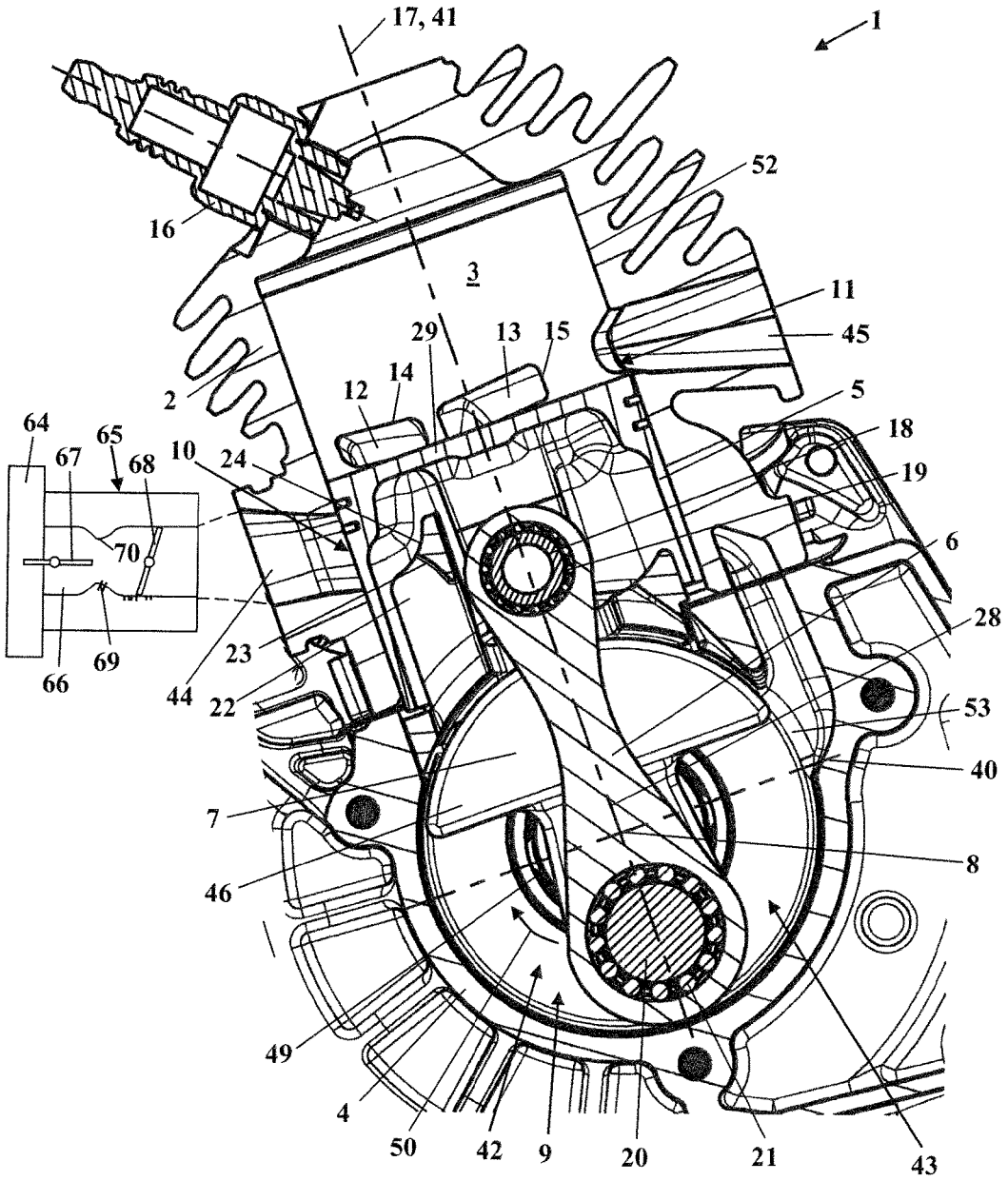
FIG. 1 shows a section through a two-stroke engine when the piston is at bottom dead center.

FIG. 1 shows a two-stroke engine 1 in a longitudinal sectional illustration. The two-stroke engine 1 has a cylinder 2 and a crankcase 4. In the cylinder 2, a combustion chamber 3 is formed which is delimited by a piston 5 mounted in the cylinder 2 so as to perform a reciprocating movement. The piston 5 drives, via a connecting rod 6, a crankshaft 7 which is mounted rotatably in the crankcase interior 9. The crankshaft 7 is mounted, so as to be rotatable about an axis of rotation 8, by way of crankshaft bearings 49, one of which is partially visible in FIG. 1. The cylinder 2 has a cylinder wall 52 which forms the running surface for the piston 5 and on which an inlet window 10 and an outlet window 11 are formed. The inlet window 10 and the outlet window 11 are controlled by the piston 5. An inlet channel 44 via which fuel/air mixture is supplied into the crankcase interior 9 opens out at the inlet window 10. FIG. 1 shows the piston 5 at its bottom dead center. In this position, the inlet window 10 is closed by the piston 5. The outlet window 11 is open. An outlet channel 45 opens out at the outlet window 11. In the piston position shown in FIG. 1, exhaust gases can flow out of the combustion chamber 3 through the outlet window 11 and via the outlet channel 45.

For the supply of fuel/air mixture, a carburetor 65 is provided in the embodiment, which carburetor is schematically illustrated in FIG. 1. The carburetor 65 has an intake channel section 66 in which a choke element 67 and a throttle element 68 are arranged. In the embodiment, flaps which are mounted pivotably in the intake channel section 66 are provided as choke element 67 and throttle element 68. The intake channel section 66 is connected to an air filter 64 via which, during operation, combustion air is drawn into the intake channel section 66. In the intake channel section 66, a venturi 70 is formed in the region at which a fuel aperture 69 opens into the intake channel section 66. Further fuel apertures may be provided in the region of the throttle element 68. Via the fuel aperture 69, fuel is drawn into the combustion air flowing through the venturi 70 and is partially prepared to form a combustible fuel/air mixture. The complete preparation of the mixture takes place in the crankcase interior 9.

The cylinder 2 has a longitudinal cylinder axis 17. In the section plane shown, the longitudinal cylinder axis 17 coincides with a transverse plane 41 which encompasses the longitudinal cylinder axis 17 and the axis of rotation 8 of the crankshaft 7. The transverse plane 41 divides an inlet end 42 of the crankcase 4 from an outlet end 43. At the inlet end 42, the inlet window 10 opens out, at the top dead center of the piston, into the crankcase interior 9. The connecting rod 6 is pivotably mounted, by way of a piston pin bearing 19, on a piston pin 18 of the piston 5. The other end of the connecting rod 6 is mounted by way of a crankpin bearing 21 on a crankpin 20 of the crankshaft. The crankpin 20 connects two crank webs 46 which are arranged to both sides of the connecting rod 6. During operation, the crankshaft 7 rotates in a rotational direction 50 which is oriented such that, during the upward stroke of the piston, the crankpin 20 moves in the direction of the combustion chamber 3 at the inlet end 42, and during the downward stroke of the piston 5, the crankpin moves away from the combustion chamber 3 at the outlet end 43.

In the embodiment, the two-stroke engine 1 has two transfer channels 12 close to the inlet and two transfer channels 13 close to the outlet, which are arranged symmetrically with respect to the section plane in FIG. 1. In the embodiment, all of the transfer channels 12 and 13 open out into the crankcase at a common outlet opening 53. It is however also possible for separate outlet openings to be provided for one, multiple or all of the transfer channels. In the region of the bottom dead center of the piston 5, the transfer channels 12 and 13 connect the crankcase interior 9 to the combustion chamber 3, such that fuel/air mixture can flow from the crankcase interior 9 into the combustion chamber 3. The transfer channels 12 close to the inlet open out by way of transfer windows 14 close to the inlet on the cylinder wall 52, and the transfer channels 13 close to the outlet open out by way of transfer windows 15 close to the outlet on the cylinder wall 52. The transfer windows 14 and 15 are also controlled by the piston 5. A spark plug 16 for the ignition of the fuel/air mixture in the combustion chamber 3 projects into the combustion chamber 3.

Two-stroke engines preferably run at very high rotational speeds. The nominal rotational speed may for example lie in the range from approximately 10,000 to 16,000 revolutions per minute. The lubrication of the piston pin bearing 19, of the crankpin bearing 21 and of the crankshaft bearing during operation is realized by way of two-stroke oil which is admixed to the fuel/air mixture flowing in through the inlet window 10. Here, a mixture ratio of oil to fuel of 1:25 to 1:50 is normally provided. The fuel/air mixture flowing in through the inlet window 10 has only been partially prepared to form a combustible mixture and has a high concentration of oil and fuel, because the complete preparation to form a combustible mixture takes place for the first time in the crankcase interior 9. To realize adequate cooling and lubrication during operation, a flow guide element 22 is arranged in the crankcase interior 9. The flow guide element 22 extends at least partially adjacent to the inlet window 10. On the flow guide element 22 a first inflow surface 23 is formed which diverts a first partial quantity of the fuel/air mixture flowing in through the inlet window 10 into the crankcase interior 9 in the direction of the crankshaft 7. The first partial quantity of the fuel/air mixture is in this case diverted into a region through which at least one element of the crankshaft 7 moves during operation. In the embodiment, the first inflow surface 23 is oriented such that the first partial quantity is diverted to the inlet end 42 of the crankcase 4. Here, the first partial quantity of the fuel/air mixture advantageously flows into a region through which the crankpin bearing 21 moves during the upward stroke of the piston 5. During the upward stroke of the piston 5, the inlet window 10 is opened by the piston skirt, such that fuel/air mixture can flow into the crankcase interior 9 through the inlet window 10. The orientation of the first inflow surface 23 is advantageously selected such that the crankpin bearing 21 passes through the mixture that is conducted into the crankcase interior 9 by the first inflow surface 23. Good lubrication of the crankpin bearing 21 is realized in this way.

As shown in FIG. 1, the flow guide element 22 has a second inflow surface 24. The second inflow surface 24 is oriented so as to divert a second partial quantity of the fuel/air mixture flowing in through the inlet window 10 in the direction of the bottom side of the piston base 29 of the piston 5. The piston base 29 is in this case that region of the piston 5 which forms a delimiting wall for the combustion chamber 3 and which separates the combustion chamber 3 from the crankcase interior 9. It may however also be provided that the flow guide element 22 has only a first inflow surface 23, and no second inflow surface 24.

When, during operation, the piston 5 moves upward toward the combustion chamber 3 from the bottom dead center shown in FIG. 1, fuel/air mixture in the combustion chamber 3 is compressed. In the region of the top dead center of the piston 5, the fuel/air mixture in the combustion chamber 3 is ignited by the spark plug 16. As soon as the inlet window 10 opens, fresh fuel/air mixture flows through the inlet channel 44 into the crankcase interior 9. During the downward stroke of the piston 5, the fuel/air mixture in the crankcase interior 9 is compressed. As soon as the outlet window 11 is opened by the piston 5, exhaust gases flow out of the combustion chamber 3 through the outlet duct 45. As soon as the transfer windows 14 and 15 are opened by the piston 5 during the further downward stroke of the piston 5, fresh fuel/air mixture flows into the combustion chamber 3 from the crankcase interior 9 through the transfer channels 12 and 13. Residual exhaust gases from the combustion chamber 3 are scavenged through the outlet window 11 by the inflowing mixture. During the next upward stroke of the piston 5, the fresh mixture that is now arranged in the combustion chamber 3 is compressed and is ignited in the region of the top dead center of the piston 5.

Figure 2:
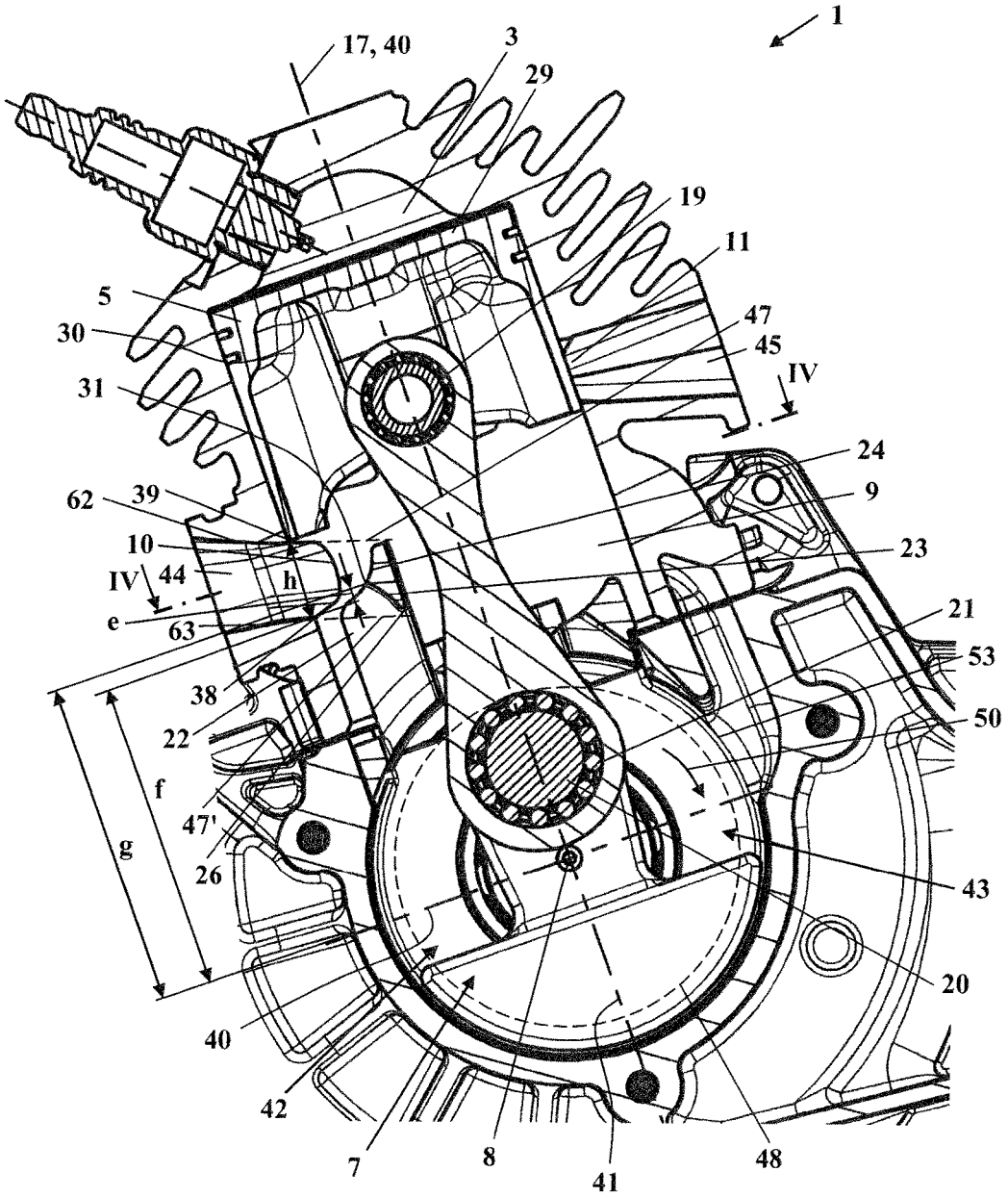
FIG. 2 shows a section through the two-stroke engine when the piston is at top dead center.

FIG. 2 shows the two-stroke engine 1 in a situation in which the piston 5 is situated at top dead center. In this position of the piston 5, the inlet window 10 is fully open. The outlet window 11 is closed by the piston 5. FIG. 2 shows the arrangement of the inflow surfaces 23 and 24 in the crankcase interior 9 in detail. The crankcase interior 9 in this case denotes the region which is separated from the combustion chamber 3 by the piston 5, and the size of which changes during the piston stroke. The inflow surfaces 23 and 24 are arranged directly opposite the inlet window 10. The inlet channel 44 has a top side 62 and a bottom side 63. The top side 62 is in this case the side close to the combustion chamber, and the bottom side 63 is that side of the inlet channel 44 which is close to the crankcase. If the top side 62 and the bottom side 63 of the inlet channel 44 are imagined as being extended into the crankcase interior 9 in the section plane shown, which encompasses the longitudinal cylinder axis 17 and which is arranged perpendicular to the axis of rotation 8 of the crankshaft 7, it is the case that, in the embodiment, the inflow surfaces 23 and 24 are situated entirely between an extension 47 of the top side 62 and an extension 47' of the bottom side 63 of the inlet channel 44. The inflow surfaces 23 and 24 are advantageously arranged at least partially between the extensions 47 and 47'. Here, the inflow edge advantageously lies in the main flow direction and advantageously divides the flow. The inlet window 10 has a bottom edge 38, which denotes that region of the inlet window 10 which has the smallest spacing to a crankshaft plane 40. The crankshaft plane 40 is the plane which encompasses the axis of rotation 8 of the crankshaft 7 and which is arranged perpendicular to the longitudinal cylinder axis 17 and thus also perpendicular to the transverse plane 41. The inlet window 10 furthermore has a top edge 39, which denotes that region of the inlet window 10 which has the greatest spacing, measured parallel to the longitudinal cylinder axis 17, to the crankshaft plane 40. The inlet window 10 has a height (h) measured parallel to the longitudinal cylinder axis 17, which height corresponds to the spacing between the bottom edge 38 and the top edge 39. The top side 62 of the inlet channel 44 has a greater spacing than the bottom side 63 of the inlet channel to the crankshaft plane 40. In the embodiment, the inlet window 10 has an approximately circular form. Some other shape of the inlet window 10 may however also be advantageous.

In the embodiment, the first inflow surface 23 and the second inflow surface 24 abut against one another at a flow divider 31. In the embodiment, the flow divider 31 is in the form of a straight edge running parallel to the axis of rotation 8 of the crankshaft 7. The flow divider 31 forms the inflow edge for the first inflow surface 23 and the second inflow surface 24, that is, the region at which the fuel/air mixture flowing in through the inlet window 10 impinges on the inflow surfaces (23, 24). Here, the inflow edge need not be in the form of a sharp edge, but rather may also be of rounded form. The flow divider 31 splits up the inflowing flow between the two inflow surfaces 23 and 24. The flow divider 31 is arranged approximately centrally in the extension 47 of the inlet duct 44. The flow divider 31 has a spacing (e), measured parallel to the longitudinal cylinder axis 17, to the bottom edge 38, the spacing advantageously being less than 50% of the height (h) of the inlet window 10. The spacing (e) advantageously amounts to 25% to 50% of the height (h) of the inlet window 10. The spacing (e) is selected such that the flow divider 31 is arranged considerably below the top edge 39 of the inlet window 10. The bottom edge 38 has a spacing (f) to the crankshaft plane 40, the spacing being smaller than a spacing (g) of the flow divider 31 to the crankshaft plane 40. As also shown in FIG. 2, the inflow surfaces 23 and 24 are both of concave form. In cross section, the flow divider 31 forms, with the inflow surfaces 23 and 24, an approximately triangular or arrow-shaped contour with arcuate side surfaces.

In FIG. 2, the rotational circle 48 of the crankpin bearing 21 is indicated by a dashed line. The rotational circle 48 is formed by the points at which the in each case radially outermost point of the crankpin bearing 21 is situated for every position of the crankshaft 7. The first inflow surface 23 is advantageously formed and arranged such that the first partial quantity of the inflowing fuel/air mixture flows, at the inlet end 42 of the crankcase interior 9, into the region situated within the rotational circle 48. Good lubrication of the crankpin bearing 21 is ensured in this way. The second inflow surface 24 is oriented such that the second partial quantity of the inflowing fuel/air mixture is conducted to a bottom side 30 of the piston base 29. The second partial quantity is advantageously guided into a region between the bottom side 30 of the piston base 29 and the piston pin bearing 19, such that both good cooling of the piston base 29 and also good lubrication of the piston pin bearing 19 are realized.

Figure 3:
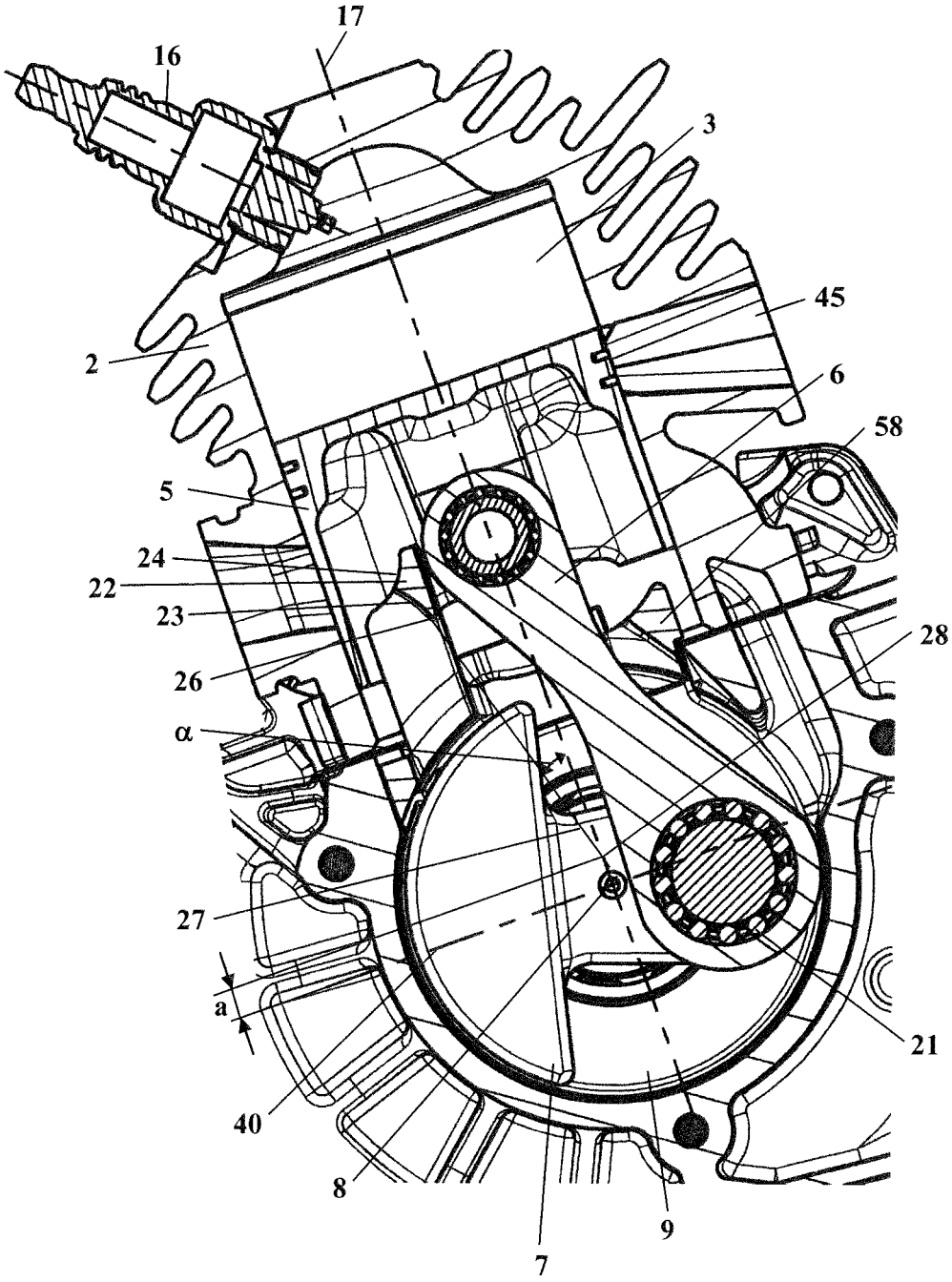
FIG. 3 shows a section through the two-stroke engine during the downward stroke of the piston immediately prior to the opening of the outlet window.

As shown in FIG. 3, the first inflow surface 23 has a separation edge 26 which denotes the region at which the fuel/air mixture separates from the first inflow surface 23. Here, the separation edge 26 need not be in the form of a sharp edge, but rather may also run in rounded fashion or may have some other suitable shape. In FIG. 3, a tangent 27 to the first inflow surface 23 is plotted, which tangent runs through the separation edge 26. In the sectional view shown, the tangent 27 intersects the longitudinal cylinder axis 17 at an intersection point 28 which is arranged on that side of the crankshaft plane 40 which faces toward the combustion chamber 3. In the embodiment, the intersection point 28 has a spacing (a) of advantageously less than 2 cm to the crankshaft plane 40. The spacing (a) preferably amounts to less than 1 cm. The tangent 27 runs at an angle α relative to the longitudinal cylinder axis 17, which angle opens in the direction of the combustion chamber 3 and advantageously amounts to 5° to 40°, in particular 10° to 25°. By way of this orientation of the first inflow surface 23, it is achieved that the mixture flows into a region of the crankcase interior 9 through which the crankpin bearing 21 passes. At the outlet end 43, a flow guide element 58 is arranged in the crankcase interior 9, which flow guide element causes the mixture circulating in the crankcase interior 9 with the crankshaft 7 to be split up. Adequate cooling of the piston 5 is ensured in this way.

Figure 4:
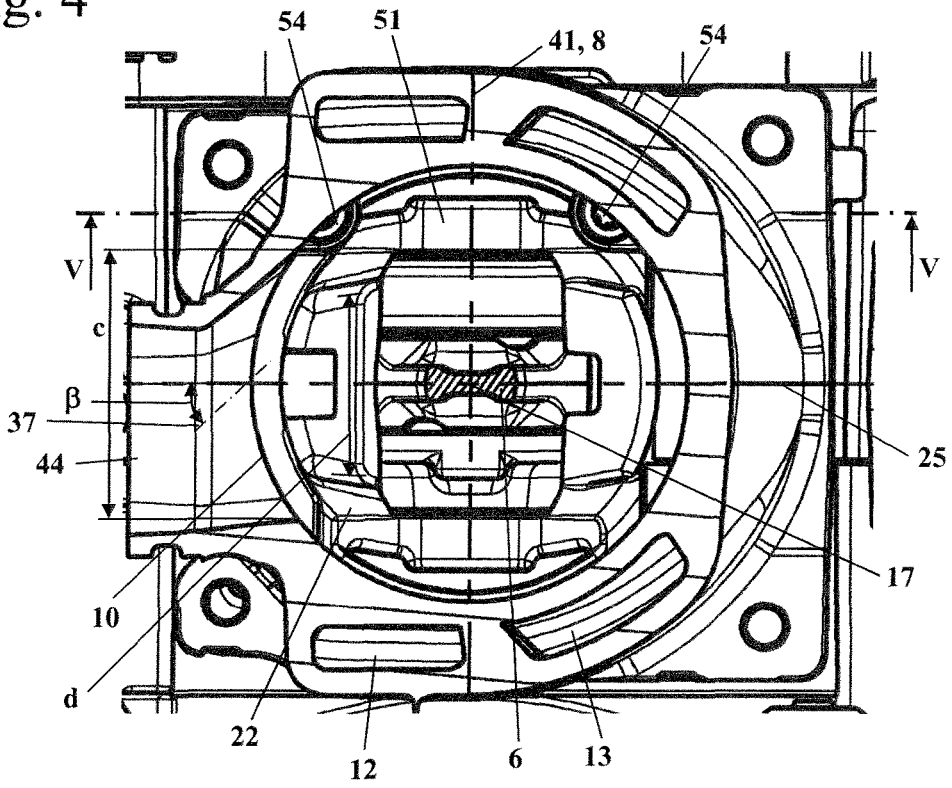
FIG. 4 shows a section along the line IV-IV in FIG. 2.

As shown in FIG. 4, the inlet window 10 has a width (c) measured parallel to the axis of rotation 8 of the crankshaft 7, the width being smaller than a greatest width (d) of the second inflow surface 24.

The two-stroke engine 1 has an imaginary central plane 25 which is perpendicular to the axis of rotation 8 of the crankshaft 7 and to the transverse plane 41 and which encompasses the longitudinal cylinder axis 17. As shown in FIG. 4, the inlet channel 44 does not run symmetrically with respect to the imaginary central plane 25, but is inclined relative to the imaginary central plane 25 in the region adjoining the inlet window 14. In the embodiment, the longitudinal central axis 37 of the inlet channel 44 in the region adjoining the inlet window 10 encloses an angle β with the imaginary central plane 25. In the embodiment, the angle β amounts to more than 10°. A symmetrical configuration of the inlet channel 44 with respect to the central plane 25 may however also be advantageous.

As is also shown in FIG. 4, the flow guide element 22 is formed on an intermediate part 51 which is fixed to the two-stroke engine 1 by way of fastening screws 54. The transfer channels 12 and 13 are also clearly visible in FIG. 4.

Figure 5:
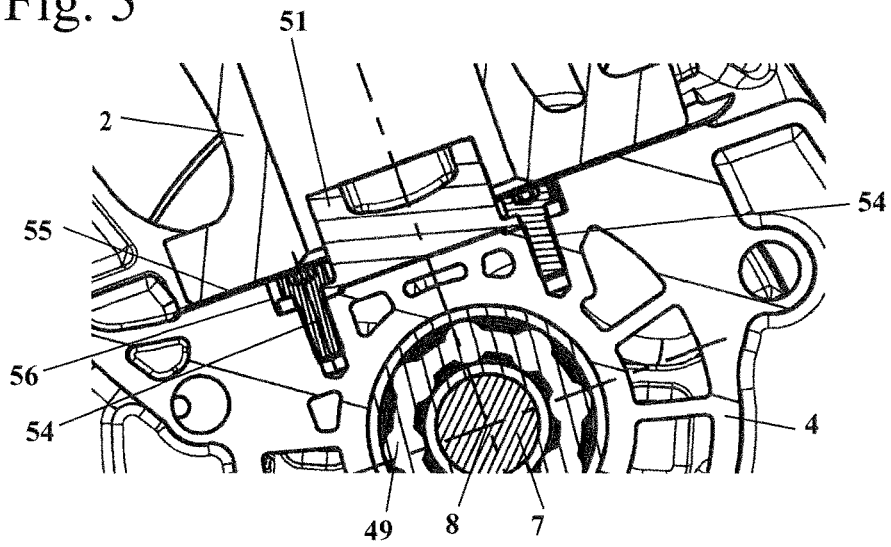
FIG. 5 shows a section along the line V-V in FIG. 4 in a detail illustration.

The fastening of the intermediate part 51 to the crankcase 4 is shown in FIG. 5. In the section plane shown in FIG. 5, two fastening screws 54 are provided, by way of which the intermediate part 51 is screwed to the crankcase 4. The cylinder 2 is mounted onto the crankcase 4 at a partition plane 55. Here, a seal is advantageously arranged between the cylinder 2 and the crankcase 4. The intermediate part 51 is arranged in a depression 56 on the top side, facing toward the cylinder 2, of the crankcase 4. The fastening screws 54 do not project beyond the partition plane 55. FIG. 5 also shows the crankshaft bearing 49, by way of which the crankshaft 7 is mounted in the crankcase 4.

Figure 6:
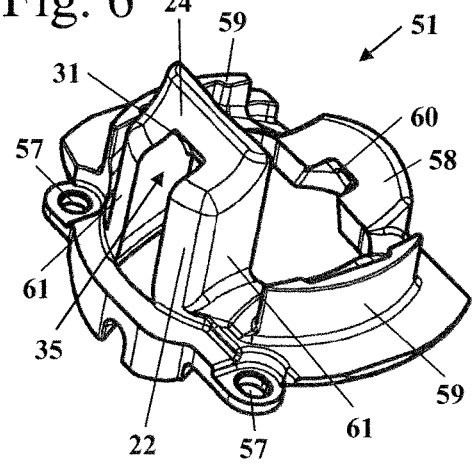
FIG. 6 and FIG. 7 show perspective illustrations of an intermediate part of the two-stroke engine.
Figure 7:
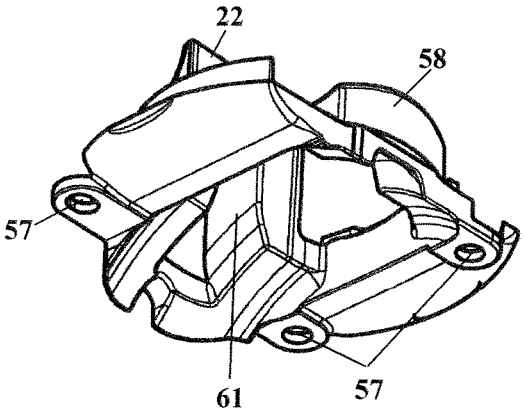

FIGS. 6 to 10 show the intermediate part 51 in detail. As shown in FIGS. 6 and 7, a total of three fastening openings 57 for fastening screws 54 are provided on the intermediate part 51. Aside from the flow guide element 22, which is arranged adjacent to the inlet, the flow guide element 58 is also formed on the intermediate part 51, which flow guide element 58 is arranged at the outlet end 43 of the two-stroke engine (FIG. 3). Webs 59 are also provided on the intermediate part 51. The webs, at bottom dead center, project into the space below the piston 5 and thereby reduce the volume of the crankcase interior 9, such that the pre-compression in the crankcase interior 9 is intensified. The flow guide element 22 has a cutout 35, and the second flow guide element 58 has a cutout 60. The cutouts 35 and 60 are provided such that the connecting rod 6, during its movement, cannot come into contact with the flow guide elements 22 and 58.

Figure 8:
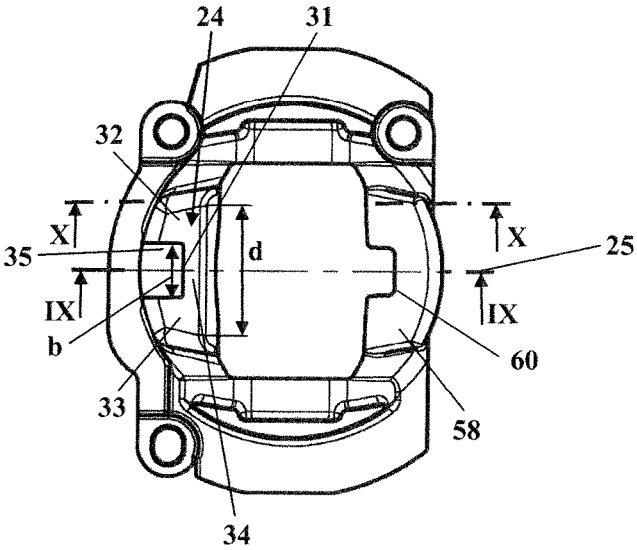
FIG. 8 shows a plan view of the intermediate part from FIGS. 6 and 7.
Figure 9:
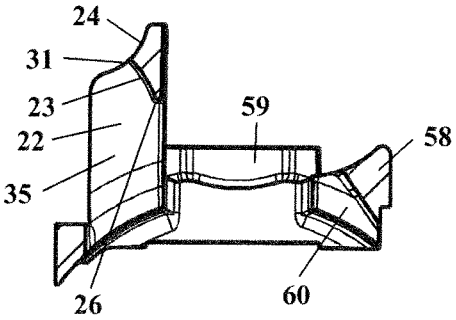
FIG. 9 shows a section along the line IX-IX in FIG. 8.
Figure 10:
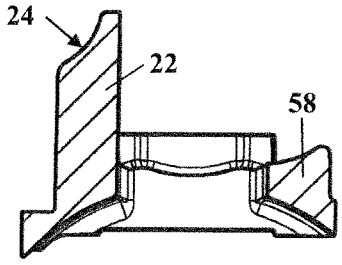
FIG. 10 shows a section along the line X-X in FIG. 8.

The flow guide element 22 has two arms 61 which are connected, at their side facing toward the combustion chamber 3, by way of the inflow surface 24. In the embodiment, the arms 61 run approximately parallel to the flow direction. Provision may however also be made for the arms 61 to be formed as a nozzle or diffuser. In the embodiment shown, in every section plane perpendicular to the longitudinal cylinder axis 17, the arms 61 run parallel to the imaginary central plane 25. The flow divider 31 is also visible in FIG. 6. The first inflow surface 23 extends between the arms 61 on the side facing toward the crankshaft plane 40 (FIG. 3). As shown by FIG. 8 in conjunction with FIG. 9, the first inflow surface 23 has a width (b), measured parallel to the axis of rotation 8 of the crankshaft 7, considerably smaller than the width (d) of the second inflow surface 24. The width (d) of the second inflow surface 24 advantageously amounts to at least 1.5 times, in particular at least 2 times, the width (b) of the first inflow surface 23. As also shown in FIG. 8, the second inflow surface 24 has a first lateral region 32 and a second lateral region 33, which are connected by way of a central region 34. The central region 34 of the second inflow surface 24 abuts against the first inflow surface 23 at the flow divider 31, as is also shown in FIG. 9. The lateral regions 32 and 33 are preferably arranged, in a viewing direction perpendicular to the transverse plane 41 (FIG. 4), laterally adjacent to the first inflow surface 23. In the region, the second inflow surface 24 has the same spacing as the first inflow surface 23 to the crankshaft plane 40 (FIG. 3). As also shown in FIG. 8, the inflow surfaces 23 and 24 are formed symmetrically with respect to the central plane 25. Both inflow surfaces (23, 24) are divided centrally by the central plane 25. Fuel/air mixture that is diverted in the direction of the crankshaft 7 by the first inflow surface 23 flows through between the arms 61 of the flow guide element 22. In so doing, the fuel/air mixture passes through the cutout 35.

In the embodiment, the flow guide element 22 is provided on an intermediate part 51 which is formed separately from the crankcase 4 and from the cylinder 2. It may however also be expedient for the flow guide element 22 and/or the flow guide element 58 to be formed on the crankcase 4, that is, formed in one piece with components of the crankcase 4. Some other suitable fastening, for example by way of welding, may also be advantageous.

It is understood that the foregoing description is that of the preferred embodiments of the invention and that various changes and modifications may be made thereto without departing from the spirit and scope of the invention as defined in the appended claims.

What is claimed is:

1. A two-stroke engine comprising:

a cylinder defining a longitudinal cylinder axis and having a combustion chamber formed therein;

a piston arranged in said cylinder so as to carry out a reciprocating back and forth movement therein;

said piston delimiting the combustion chamber;

a crankcase defining an interior;

an inlet window controlled by said piston for supplying a fuel/air mixture to said crankcase;

an outlet window leading out of said combustion chamber;

at least one transfer channel via which combustion air flows from said interior of said crankcase into said combustion chamber;

a crankshaft rotatably journaled in said crankcase for rotating about a rotational axis;

a connecting rod connected to said piston via a piston pin;

said piston driving said crankshaft via said connecting rod;

said connecting rod being journaled on a crankpin of said crankshaft;

said piston having a piston base defining a lower end facing toward said crankcase;

a flow guide element arranged in said interior of said crankcase so as to extend adjacent to said inlet window;

said flow guide element having at least a first inflow surface configured to divert at least a first partial quantity of said fuel/air mixture flowing in through said inlet window in a direction toward said crankshaft;

said crankcase having an inlet side and an outlet side;

said inlet side and said outlet side being mutually separated by a transverse plane;

said transverse plane encompassing said longitudinal cylinder axis and said rotational axis; and, said first inflow surface diverting said first partial quantity of said inflowing fuel/air mixture to said inlet side of said crankcase.

2. A two-stroke engine comprising:

a cylinder defining a longitudinal cylinder axis and having a combustion chamber formed therein;

a piston arranged in said cylinder so as to carry out a reciprocating back and forth movement therein;

said piston delimiting the combustion chamber;

a crankcase defining an interior;

an inlet window controlled by said piston for supplying a fuel/air mixture to said crankcase;

an outlet window leading out of said combustion chamber;

at least one transfer channel via which combustion air flows from said interior of said crankcase into said combustion chamber;

a crankshaft rotatably journaled in said crankcase for rotating about a rotational axis;

a connecting rod connected to said piston via a piston pin;

said piston driving said crankshaft via said connecting rod;

said connecting rod being journaled on a crankpin of said crankshaft;

said piston having a piston base defining a lower end facing toward said crankcase;

a flow guide element arranged in said interior of said crankcase so as to extend adjacent to said inlet window;

said flow guide element having at least a first inflow surface configured to divert at least a first partial quantity of said fuel/air mixture flowing in through said inlet window in a direction toward said crankshaft;

an inlet channel opening at said inlet window and having a top side and a bottom side;

said first inflow surface lying in a section plane;

said section plane encompassing said longitudinal cylinder axis and being perpendicular to said rotational axis of said crankshaft; and, said first inflow surface being arranged in said section plane to lie at least partially between an extension of said top side of said inlet channel and an extension of said bottom side of said inlet channel.

3. The two-stroke engine of claim 1, wherein:

said first inflow surface has an inflow edge facing toward said inlet window;

said crankcase defines a crankshaft plane; and, said crankshaft plane encompasses said rotational axis of said crankshaft and is perpendicular to said longitudinal cylinder axis.

4. The two-stroke engine of claim 3, wherein:

said inflow edge and said crankshaft plane conjointly define a spacing (g) therebetween measured parallel to said longitudinal cylinder axis;

said inlet window has a lower edge and said lower edge and said crankshaft plane conjointly define a spacing (f) therebetween measured parallel to said longitudinal cylinder axis; and, said spacing (g) is greater than said spacing (f).

5. The two-stroke engine of claim 3, wherein:

said inflow edge and said lower end conjointly define a spacing (e) measured parallel to said longitudinal cylinder axis;

said inlet window has a height (h) measured parallel to said longitudinal cylinder axis; and, said spacing (e) is not more than 50% of said height (h).

6. The two-stroke engine of claim 1, wherein:

said two-stroke engine defines an imaginary central plane;

said first inflow surface has a separation edge on the side thereof facing away from said combustion chamber;

said imaginary central plane encompasses said longitudinal cylinder axis; and, said imaginary central plane is perpendicular to said rotational axis of said crankshaft.

7. The two-stroke engine of claim 6, wherein, viewed in a direction toward said imaginary central plane, a tangent, which runs through said separation edge, intercepts said cylinder longitudinal axis at an intercept which is at a distance (a) of less than 2 cm to said rotational axis of said crankshaft.

8. The two-stroke engine of claim 7, wherein, viewed in a direction toward said imaginary central plane, said tangent and said cylinder longitudinal axis conjointly define an angle $\alpha$ lying in a range of 5° to 40°.

9. A two-stroke engine comprising:

a cylinder defining a longitudinal cylinder axis and having a combustion chamber formed therein;

a piston arranged in said cylinder so as to carry out a reciprocating back and forth movement therein;

said piston delimiting the combustion chamber;

a crankcase defining an interior;

an inlet window controlled by said piston for supplying a fuel/air mixture to said crankcase;

an outlet window leading out of said combustion chamber;

at least one transfer channel via which combustion air flows from said interior of said crankcase into said combustion chamber;

a crankshaft rotatably journaled in said crankcase for rotating about a rotational axis;

a connecting rod connected to said piston via a piston pin;

said piston driving said crankshaft via said connecting rod;

said connecting rod being journaled on a crankpin of said crankshaft;

said piston having a piston base defining a lower end facing toward said crankcase;

a flow guide element arranged in said interior of said crankcase so as to extend adjacent to said inlet window;

said flow guide element having at least a first inflow surface configured to divert at least a first partial quantity of said fuel/air mixture flowing in through said inlet window in a direction toward said crankshaft;

said first inflow surface having a width (b) measured parallel to said rotational axis of said crankshaft;

said inlet window having a width (c) measured parallel to said rotational axis of said crankshaft; and, said width (b) corresponding to 10% to 50% of said width (c).

10. A two-stroke engine comprising:

a cylinder defining a longitudinal cylinder axis and having a combustion chamber formed therein;

a piston arranged in said cylinder so as to carry out a reciprocating back and forth movement therein;

said piston delimiting the combustion chamber;

a crankcase defining an interior;

an inlet window controlled by said piston for supplying a fuel/air mixture to said crankcase;

an outlet window leading out of said combustion chamber;

at least one transfer channel via which combustion air flows from said interior of said crankcase into said combustion chamber;

a crankshaft rotatably journaled in said crankcase for rotating about a rotational axis;

a connecting rod connected to said piston via a piston pin;

said piston driving said crankshaft via said connecting rod;

said connecting rod being journaled on a crankpin of said crankshaft;

said piston having a piston base defining a lower end facing toward said crankcase;

a flow guide element arranged in said interior of said crankcase so as to extend adjacent to said inlet window;

said flow guide element having at least a first inflow surface configured to divert at least a first partial quantity of said fuel/air mixture flowing in through said inlet window in a direction toward said crankshaft;

said flow guide element having a second inflow surface; and, said second inflow surface being configured to divert a second partial quantity of said fuel/air mixture in a direction onto the lower side of said piston base.

11. The two-stroke engine of claim 10, wherein each of said first inflow surface and said second inflow surface is concavely curved.

12. The two-stroke engine of claim 10, wherein said first inflow surface and said second inflow surface mutually abut at a flow divider.

13. The two-stroke engine of claim 12, wherein said flow divider forms a straight edge running parallel to said rotational axis of said crankshaft.

14. The two-stroke engine of claim 10, wherein:

said first inflow surface has a width (b) measured parallel to said rotational axis of said crankshaft;

said second inflow surface has a width (d) measured parallel to said rotational axis of said crankshaft; and, said width (d) is at least 1.5 times said width (b) of said first inflow surface.

15. The two-stroke engine of claim 10, wherein:

said second inflow surface has a cutout; and, said first inflow surface borders on said cutout.

* * * * *